US006058815A

United States Patent [19]

Habermehl

[11] Patent Number: 6,058,815

[45] Date of Patent: May 9, 2000

[54] HAND HELD POWER TOOL

[76] Inventor: G. Lyle Habermehl, 436 Calvert Dr., Gallatin, Tenn. 37066

[21] Appl. No.: 09/108,578

[22] Filed: Jul. 1, 1998

Related U.S. Application Data

[63] Continuation of application No. 08/577,023, Dec. 22, 1995, abandoned.

[51] Int. Cl.[7] ..... B25B 23/04

[52] U.S. Cl. ..... 81/434; 81/57.12; 81/177.1

[58] Field of Search ..... 81/54, 57, 57.11–57.13, 81/57.28, 57.29, 57.37, 433–435, 177.1, 177.2, 489; 408/241 R, 124, 234, 712; 451/344, 357

[56] References Cited

U.S. PATENT DOCUMENTS 3,910,324 10/1975 Nasiatka .
3,930,297 1/1976 Potucek et al. .
4,347,450 8/1982 Colligan .
4,381,037 4/1983 Cuneo .
4,879,847 11/1989 Butzen et al. .

FOREIGN PATENT DOCUMENTS 0 561 233 3/1993 European Pat. Off. .
73402 2/1916 Switzerland ..... 81/177.1

*Primary Examiner*—D. S. Meislin
*Attorney, Agent, or Firm*—Riches, McKenzie & Herbert

[57] ABSTRACT

A hand held power tool with a power drive train extending externally within an elongate housing from a motor disposed near one end of the housing through a handle-forming intermediate portion of the housing to a power takeoff at another end of the housing, wherein the fingers and hand of a user grasp the handle-forming portion to substantially encircle a section of the power drive train passing through the handle-forming portion. Preferably, the hand tool is adapted for use by urging the tool manually into a workpiece and an on/off switch for the tool is activatable by pressure from the palm of a user's hand urging the tool into the workpiece.

14 Claims, 10 Drawing Sheets

FIG. 2.
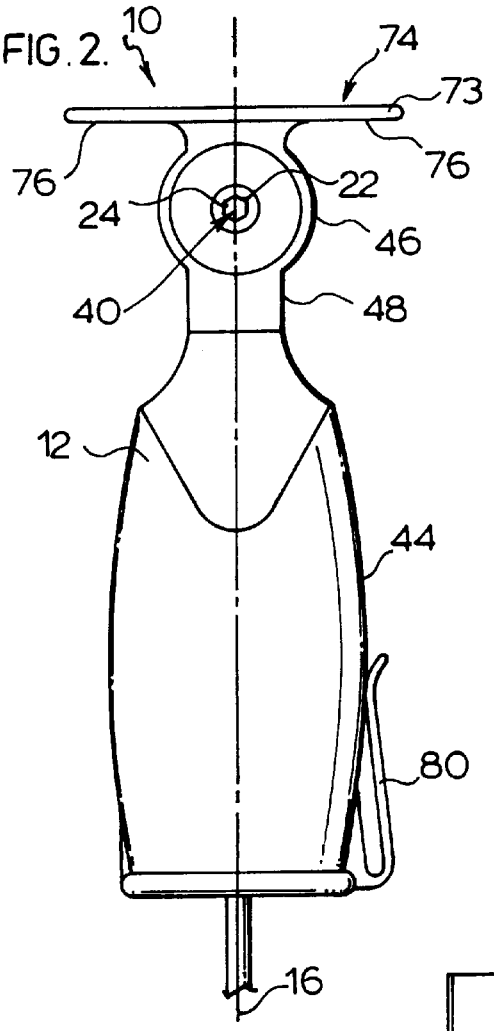
FIG. 4.
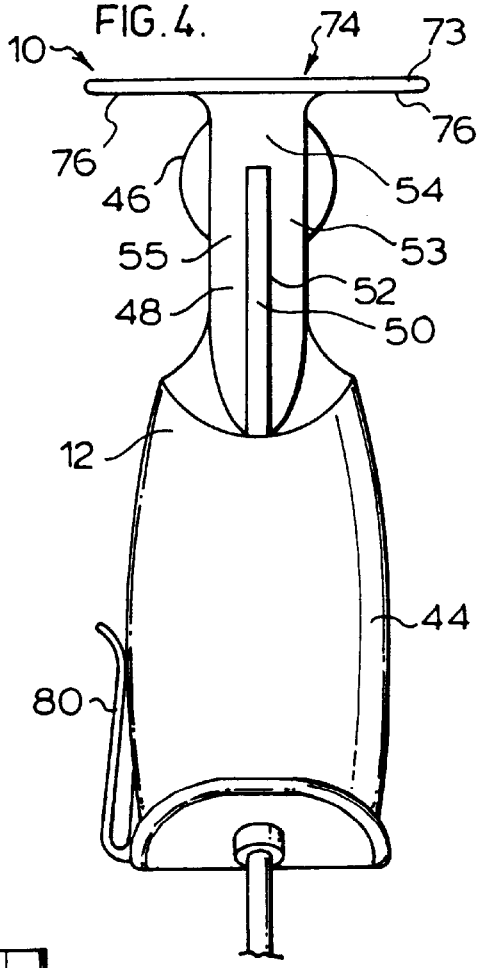
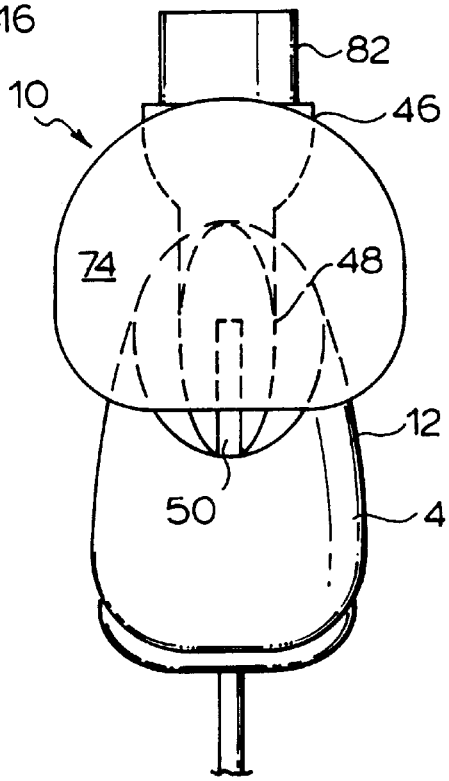
FIG. 3.

173
170
172
136
171
126
127
128
174
211
214
212
118
142
402
140
140
301
218
167
168
162
125
144
160
163
164
158
148
125
122
146
150
151
154
156
190
182
185
183
193
180
177
192
175
176
124
187
186
225
183
184
219
125

HAND HELD POWER TOOL

This is a continuation of application Ser. No. 08/577,023 filed Dec. 22, 1995, now abandoned.

FIELD OF THE INVENTION

This invention relates to hand held power tools and, particularly, to hand held screw guns and hand held drills.

BACKGROUND OF THE INVENTION

Hand held power tools are well known. Typical power drills and power screw guns have a handle which extends downwardly and from the rear of a drive motor. The drive motor rotates about an axis substantially perpendicular to the handle and with the front end of the drive motor being coupled as to a chuck for holding drills or to a screw bit which rotates parallel the axis of the drive motor. Such power tools have the disadvantage that the weight of the motor is forward of the handle and must be supported by the strength of a user's hand manually holding the tool.

Screwdriving apparatus are known for collated screws. Typical apparatus of this type are illustrated, for example, in U.S. Pat. No. 3,930,297 to Potucek et al, issued Jan. 6, 1976, U.S. Pat. No. 5,027,679 to Kawashima et al, issued Jul. 2, 1991 and U.S. Pat. No. 5,186,085 to Monacelli, issued Feb. 16, 1993. Each of these patents show a power screw gun having a handle rearward of the motor and extending downwardly therefrom and an attachment coupled to the front of the screw gun which is adapted to feed collated screws in a manner that successive screws may be driven on the tool being successively urged forwardly into a workpiece. A preferred attachment for such devices is shown in U.S. Pat. No. 4,146,071 to Mueller et al, issued Mar. 27, 1979.

A disadvantage of power tools generally with a handle rearward of the motor and particularly of such devices when used for driving collated screws is that the handle is distanced from the workpiece to be engaged which causes difficulty in control as well as increased weight to be supported by the hand of a user.

U.S. Pat. No. 4,623,597 to Cast issued Dec. 2, 1986 and U.S. Pat. No. 5,109,738 to Farian et al, issued May 5, 1992, teach collated screwdriving apparatus in which a handle extends perpendicularly from the axis of a motor and is located under the motor, that is, forwardly from the rear of the motor. These devices while, to some extent, overcome the difficulties of having the substantial weight of the tool forward of the handle, continue to have the disadvantage of resulting in a large tool and with the substantial weight of the motor supported above the handle and in the way of a user of the tool.

Another disadvantage of known hand held power tools, such as typical power drills and screw guns, is that a trigger switch is provided on a forward end of the handle which trigger switch must be drawn towards the handle by the fingers of a user in order to operate the tool. This has the disadvantage of being tiring to a user when a tool is used for an extended period of time. Some tools are provided with a locking mechanism which permits the trigger to be locked in an operative position, however, this has the disadvantage of being unsafe in certain circumstances.

SUMMARY OF THE INVENTION

To at least partially overcome some of these disadvantages of the previously known devices, the present invention provides a power tool with a power drive train extending internally within a housing from a motor disposed near one end of the housing to a power takeoff at the other end of the housing such that the power train extends through an intermediate handle-forming portion of the housing adapted to be grasped by a hand of the user.

To at least partially overcome the disadvantages of the prior art, the present invention also provides a power operated hand tool adapted for use by urging the tool manually into a workpiece in which an on/off switch for the tool is activatable by pressure from the palm of a user's hand urging the tool into the workpiece.

An object of the present invention is to provide hand held power tools with a handle between a drive motor and the power takeoff from the tool.

Another object is to provide a hand tool in which the handle is disposed proximate the center of gravity of the tool.

Another object is to provide a hand tool in which the motor rotates about a motor axis disposed at a substantial angle to the axis about which the power takeoff rotates.

Another object is to provide a compact lightweight arrangement for a hand held screwdriving gun for automatic advancing and driving of collated screws.

Another object is to provide a hand held power tool with an on/off switch which is operative by pressure from a user's hand urging the tool into a workpiece.

Another object is to provide a hand tool with an on/off switch provided on a rear portion of a handle.

Another object is to provide an on/off switch on a power hand tool for operation by engagement with the palm of a user's hand.

Another object is to provide a tool end, particularly, a balanced tool which assists in reducing hand and arm fatigue in use.

Another object is to provide a tool and, preferably, a tool for driving collated screws which has its mass generally symmetrical about a central vertical plane passing through the tool centrally of a handle for the tool.

Accordingly, in a first aspect, the present invention provides a hand held power tool with a power drive train extending externally within an elongate housing from a motor disposed near one end of the housing through a handle-forming intermediate portion of the housing to a power takeoff at another end of the housing, wherein the fingers and hand of a user grasp the handle-forming portion to substantially encircle a section of the power drive train passing through the handle-forming portion.

In a second aspect, the present invention provides in a power operated hand tool adapted for use by urging the tool manually into a workpiece, the improvement wherein an on/off switch for the tool is activatable by pressure from the palm of a user's hand urging the tool into the workpiece.

In a third aspect, the present invention provides a power operated hand tool having a front end for urging in a forward direction into a workpiece, a handle for grasping by the hand of a user, a rear surface portion provided on a side of the handle opposite to the front end for engagement by a portion of the palm of a user's hand; a switch for switching the tool between an inoperative condition and an operative condition, the switch carried on the rear surface portion of the handle and movable between an extended position in which the switch extends rearwardly from the handle and a retracted operative position in which the switch is retracted forwardly into the handle, the switch biased for movement towards the rearward extended inoperative position, wherein on a user's hand grasping the handle of the tool and urging the tool forwardly into a workpiece, the switch is urged by the palm of the hand into the operative retracted position.

BRIEF DESCRIPTION OF THE DRAWINGS

Further aspects and advantages of the present application will become apparent from the following description taken together with the accompanying drawings and in which:

FIGS. 2, 3 and 4 are, respectively, front view, a top view and a rear view of the screw gun of FIG. 1;

DETAILED DESCRIPTION OF THE DRAWINGS

Figure 5:
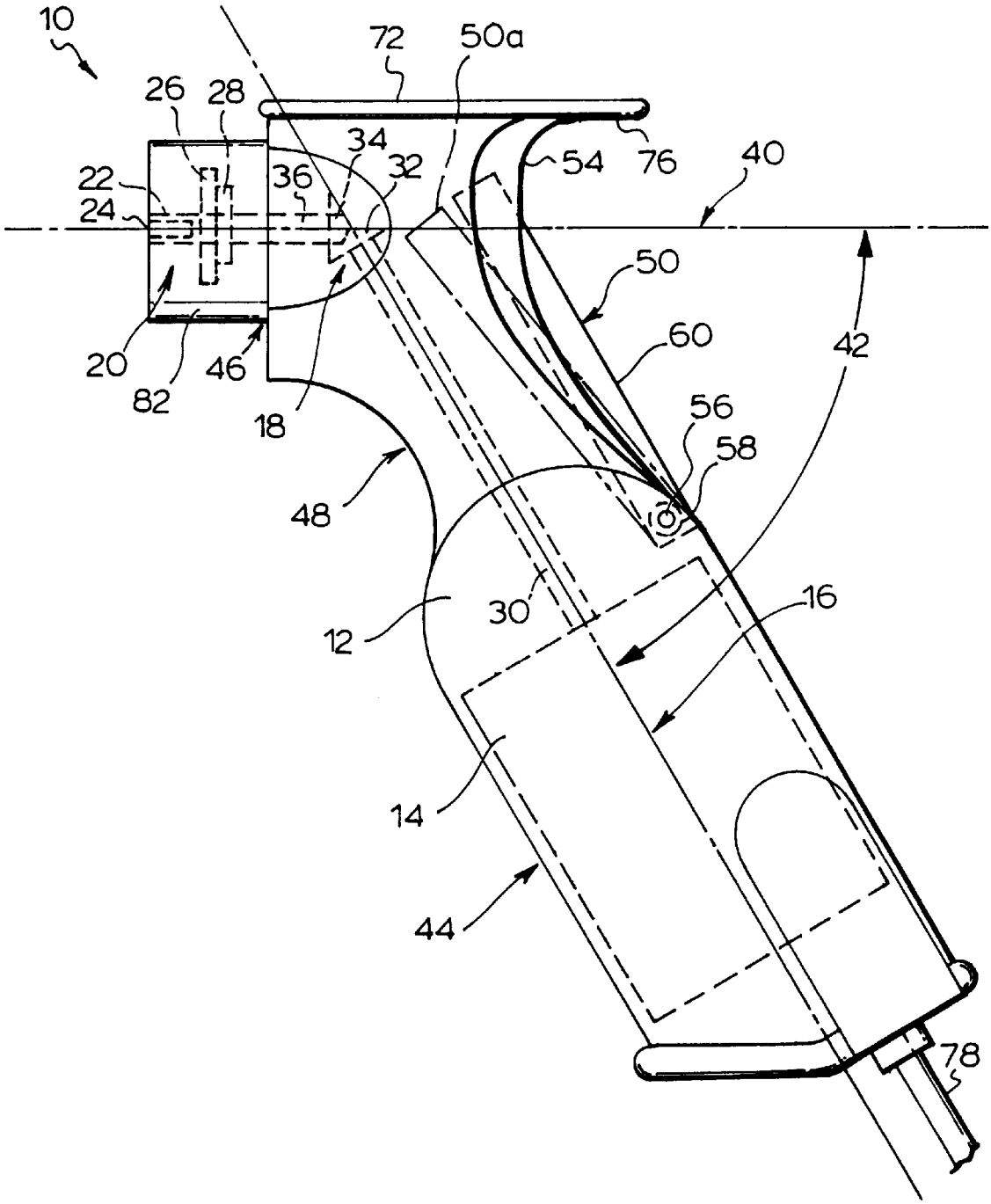
FIG. 5 is a side view of the screw gun of FIG. 1 but schematically illustrating internal functional features.

Reference is made to FIGS. 1 to 5 which show a preferred embodiment of a screw gun 10 having a housing generally indicated as 12. FIG. 5 comprises a side view and in which there are schematically shown in dotted lines a number of the functional elements of the screw gun 10 disposed within the housing 12. In this regard, FIG. 5 shows a motor 14 rotatable about a motor axis 16. The motor 14 is connected via a transmission mechanism generally indicated 18 to a power takeoff mechanism generally indicated 20. The takeoff mechanism in the preferred embodiment is shown as comprising a hex coupling 22 adapted in a known manner to removably receive coaxially within its hexagonal bore 24 conventional screwdriver bits and mandrels having a corresponding hexagonal outer surface. The takeoff mechanism 20 in a conventional screw gun will also have a clutch mechanism which will permit the screwdriver bit being driven to stop rotating when the resistance to rotation of the bit, as when a screw is fully engaged into a workpiece, increases above a certain desired amount. In this regard, the takeoff mechanism is schematically shown as having two friction clutch plates 26 and 28 serving as a clutch mechanism.

The transmission mechanism generally indicated 18 which couples the takeoff mechanism 20 to the motor 14 is schematically shown as comprising a first shaft 30 coupled at one end to the motor and carrying a first bevel gear 32 rotatable therewith. The first bevel gear 32 engages with a second bevel gear 34 which is carried on a shaft 34 coupled via the clutch plates 26 and 28 of the clutch mechanism to the hex coupling 22.

Figure 1:
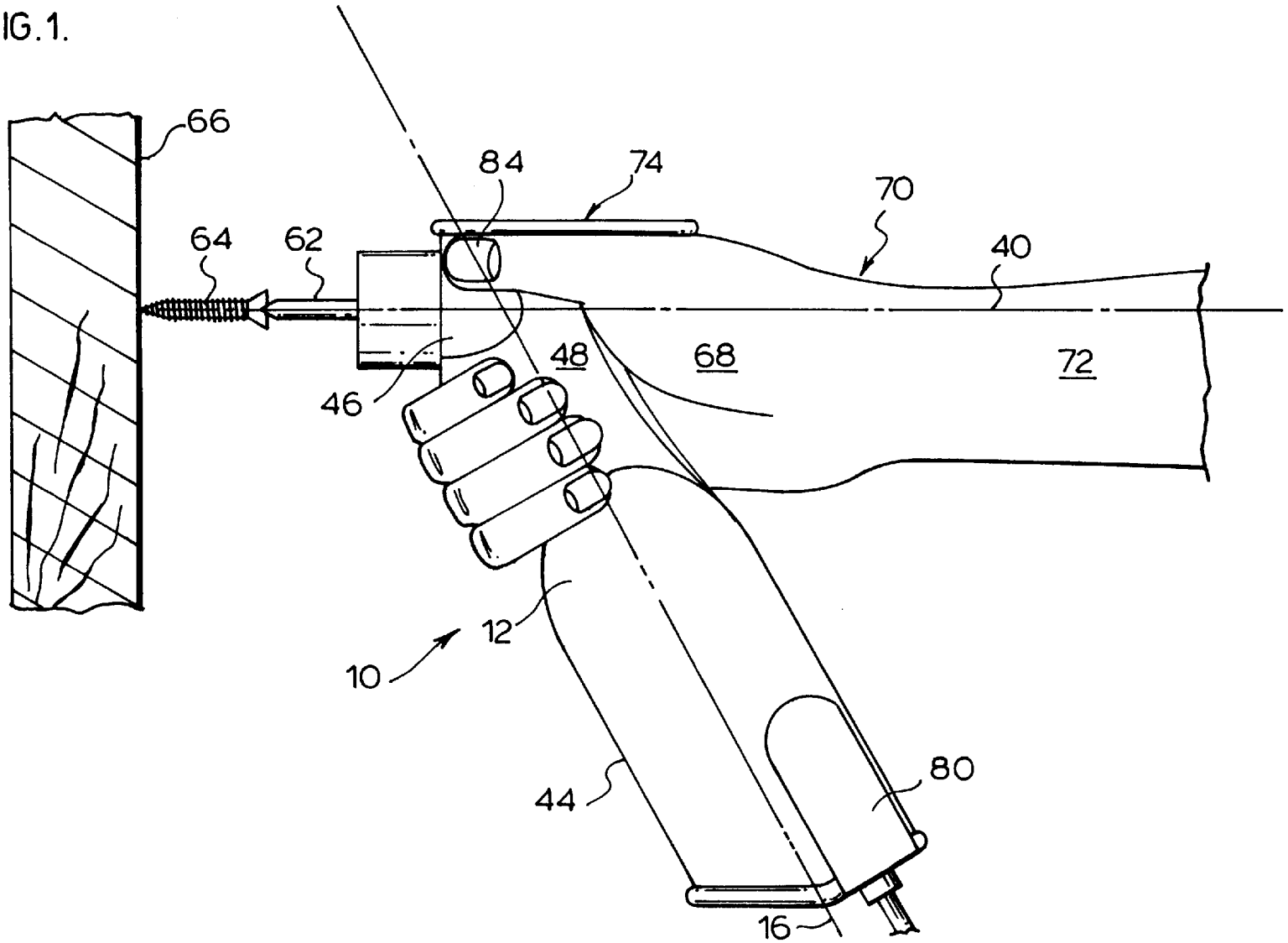
FIG. 1 is a side view of a first preferred embodiment of a hand held screw gun in accordance with the present invention shown grasped in the hand of a user and positioned to drive a screw into a workpiece with a bit.

As shown in FIG. 1, the motor 14 rotates about the motor axis 16 and the takeoff mechanism 20 and, particularly the hex coupling 22, rotates about a takeoff axis 40. In the preferred embodiment, the motor axis 16 and the takeoff axis 40 both lie in the same flat plane. The motor axis 16 and the takeoff axis 40 are both shown in FIG. 2 and the flat plane in which both the axis are preferred to lie is to be understood to extend normal to the plane of FIG. 2. As seen in FIG. 5, the motor axis 16 and takeoff axis 40 form an angle indicated generally as 42 which angle is preferably in the range of 20° to 65° and, more preferably, in the range of about 35° to 55° and, most preferably, about 45°.

The housing 12 is somewhat elongated and includes three portions. A first housing portion 44 is provided as a lowermost first rear end portion of the housing within which the motor 14 is disposed. A second housing portion 46 comprises a second uppermost forward end portion of the housing at the opposite end of the housing to the first portion 44 and within which the takeoff mechanism 20 is provided. An intermediate handle-forming portion 48 is provided inbetween the first housing portion 44 and the second housing portion 46. The transmission mechanism 18 extends internally of the housing 12 between the motor 14 and the takeoff mechanism 20 and, therefore, internally through the intermediate handle-forming housing portion 48.

The intermediate housing portion 48 is shaped so as to permit manual grasping of the screw gun 10 by the hand of a user as shown in FIG. 5. In the preferred screw gun 10 shown, the intermediate housing portion 48 is provided of a circumference which is less than the circumference of the first housing portion 44 and it is to be appreciated that the present invention is particularly adapted for use with power tools in which the motor 44 requires a motor receiving first housing portion 44 which is of a circumference which is greater than the circumference of a conventional pistol grip type handle which can be used by a typical person.

The intermediate housing portion 48 is shaped for grasping by a user with the hand, fingers and thumb of a user to substantially encircle the intermediate housing portion 48. Nevertheless, the intermediate housing portion 48 is adapted to permit the transmission mechanism 18 to pass essentially therethrough and, therefore, in effect, with the hand, fingers and thumb of the user to substantially encircle the first shaft 30 comprising a portion of the transmission mechanism 18.

FIG. 5 also schematically shows a switch mechanism including a switch 50 to switch the power on or off to the motor and thus switch the screw gun between a powered operative condition and an unpowered inoperative condition. The switch mechanism is only schematically illustrated by the switch 50 which is disposed in a slot generally indicated 52 in a rear surface 54 of the intermediate handle-forming portion 48. The switch 50 is shown schematically as a generally rectangular rod which is secured to the housing by a pivot pin 56 and is pivotable about pin 56. A spring, schematically shown as 58 in broken lines in FIG. 1, is coiled about the pivot pin 56 and has one end secured to the housing and the other end secured to the switch 50 so as to bias the switch 50 clockwise about the pivot pin 56 as seen in FIG. 5 to an extended, inoperative position, which inoperative position is shown in FIGS. 1 to 5 with rear surfaces 60 of the switch in solid lines. ,The switch may pivot about the pivot pin 56 against the bias of the spring 58 to a retracted position indicated by the switch as shown totally in dashed and dotted lines in FIG. 1 and assuming a position as identified by reference numeral 50*a*. With the switch 50 in the retracted position, the switch mechanism connects the power to the motor and the tool is in an operative condition. Stop mechanisms, not shown, are provided to limit the forward and rearward extent to which the switch 50 may pivot.

Reference is now made to FIG. 1 which shows the screw gun 10 with a bit 62 received in the hex coupling 14, a screw 64 engaged by the bit and aligned for driving into a workpiece schematically illustrated as 66. The tool as shown being grasped by the hand of a user generally indicated 68. To drive the screw 64 into the workpiece, the hand of the user, which grasps the handle so as to substantially encircle the handle, urges the entire tool into the workpiece in a direction parallel the takeoff axis 40. In urging the tool towards the workpiece along takeoff axis 40, the palm of the hand is disposed to engage the rear surface 60 of the switch 50 and, on urging of the tool forwardly into the workpiece, urges the switch 50 forwardly to pivot from the inoperative extended position to the operative retracted position. In a person driving a screw, relatively substantial forces need to be applied by the hand of the user onto the rear surfaces 60 of the intermediate handle-forming portion 48 of the housing. Such forces also serve the purpose of maintaining the switch 50 in the retracted operative condition without the need f or pressure to be applied to the switch 50 as by the fingers of the user's hand exerting pressure on the forward surfaces 72 of the intermediate handle-forming portion 48. Operation of the tool with the switch 50 engaged by the palm of the hand in the hand urging the tool into the workpiece, permits the tool to be held relatively loosely in the hand of the user without the need for the fingers apply a rearwardly directed pressure onto the forward surfaces of the tool to maintain the switch in an operative condition. In contrast, power tools having a trigger switch forward of the handle typically require such rearwardly directed finger pressure. The switch mechanism is readily operated by the rearward pressure of the palm of a hand onto the rear surfaces of the handle-forming housing portion 48.

The switch 50 illustrated in FIGS. 1 to 7 comprises a mechanically activated switch on the rear surface 50 of the handle. While a mechanical switch, which is pivoted at its lower end is illustrated, many other forms of mechanical switches may be used which are activated by rearward pressure. Preferably, the mechanical switch would engage sufficient area of the palm and/or require such pressure for activation, that discomfort would not be experienced by a user even when using the tool for an extended period of time.

Rather than use a mechanical switch, other switches such as an electronic pressure sensing member could be provided on the rear surface 60 in substitution of switch 50. Such plates are believed to be used in elevators and other devices and have no moving parts. The electronic pressure sensing member could be provided flush with the rear surfaces in the area of where the slot 52 is now provided to accommodate the mechanical switch.

As seen in FIG. 1, portions of the wrist 70 and forearm 72 of a user are shown to extend rearwardly from the tool and, preferably, substantially parallel the takeoff axis 40 as is advantageous for urging the screw gun into a workpiece. In this regard, with the hand 68 of the user grasping the tool, the takeoff axis is seen to extend rearwardly and conceptually intersect with the palm of the user.

The screw gun 10 is provided with a support mechanism 74 comprising a plate comprising a part of or secured to the housing above and adjacent the intermediate handle-forming portion 48 and which plate provides a substantially, downwardly directed, flat planar support surface 76 which is adapted to be engaged by the upper surface of the hand and wrist and, particularly, the upper surface of the thumb 84 and the rear of the index finger as well as portions of the hand and wrist rearward from the thumb and index finger as best seen in FIG. 1. The support surface 76 extends both to the sides and rearwardly of the handle-forming housing portion 48.

As may be seen in FIGS. 2, 3 and 4, the support surface extends from both sides surfaces of the handle away from the common flat plane which includes axis 16 substantially equal distances from both sides of the handle. As can best be seen from FIG. 3, the support surface is shown as symmetrical about the common flat plane which includes axis 16. Further, as seen in each of FIGS. 2, 3 and 4, the support surface extends to each side of the handle a distance from the common flat plane which includes the axis 16 substantially the same as a distance the second end portion 44 extends to each side from the common flat plane.

The support surface 76 also forms, as seen in FIG. 1, with the remainder of the rear surface 60 of the handle-forming portion 48, a U-shaped bight whose center is forwardly directed. This is advantageous such that on a user urging the tool into a workpiece with the hand, the hand will effectively be cammed and biased by the U-shaped bight towards a central alignment in the U-shaped bight which will assist in reducing the extent to which the fingers of the hand must apply rearwardly directed pressure to the handle of the tool to secure and hold the tool. In the configuration of the hand shown in FIG. 1, the fingers as they initially extend from the fingers of the palm of the hand are generally directed in a direction parallel the takeoff axis 40 as is believed to be advantageous for aiming and pointing of the tool.

The screw gun illustrated is for use with an electric motor which is shown to be powered by electricity from a flexible cord 78 to a suitable power source.

The tool is shown as having a spring clip 80 on one side as for clipping the tool to a user's belt.

The screw gun 10 is provided at the forwardmost end of the second housing portion 46, and as part of the takeoff mechanism 20, with a cylindrical coupling surface 82 coaxially about the hex coupling 22 and, therefore, the takeoff axis 40.

Figure 6:
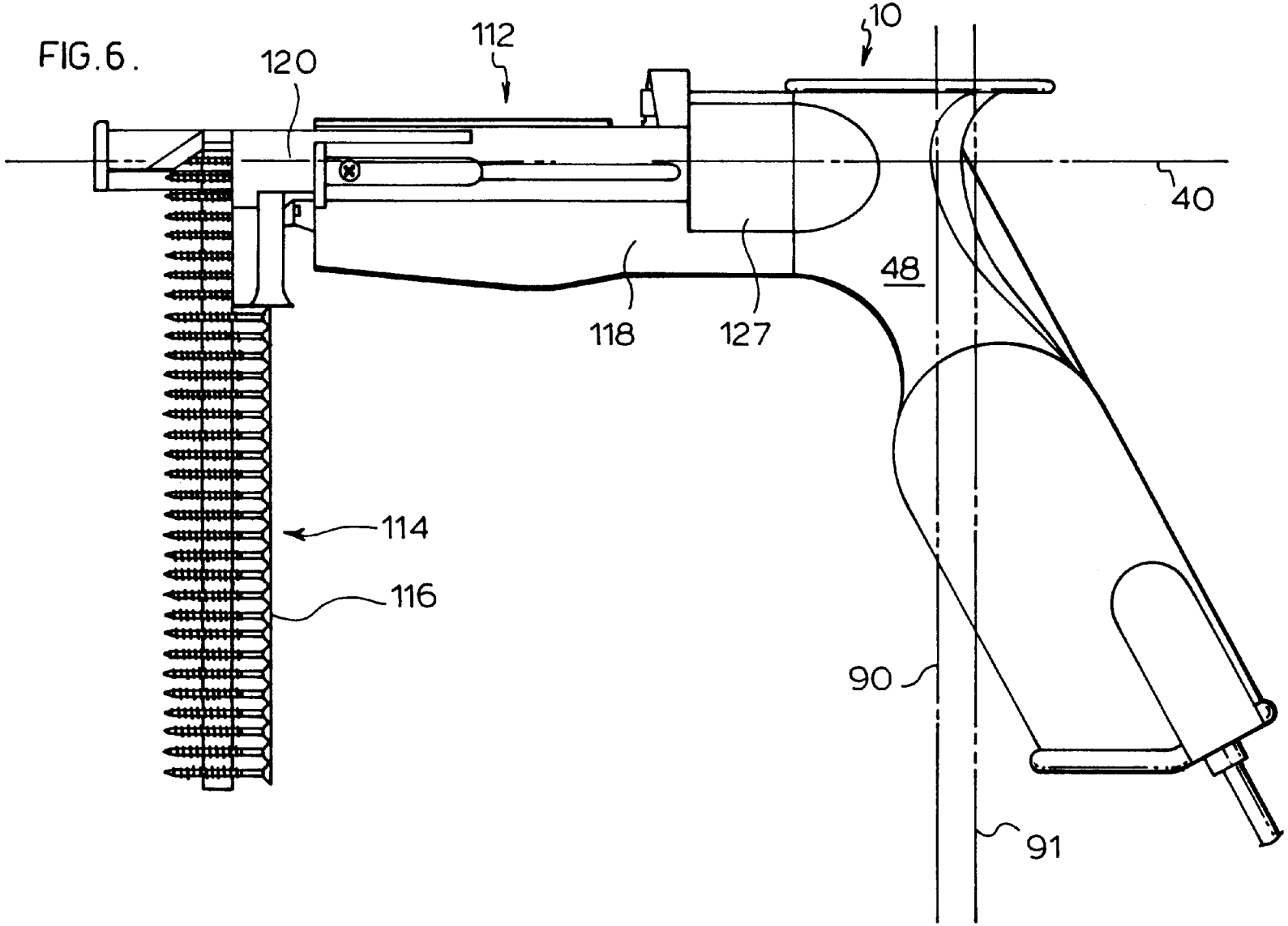
FIG. 6 is a side view of the screw gun of FIGS. 1 to 4 but with a driver attachment secured for receiving, advancing and locating collated screws to be driven.

Reference is now made to FIG. 6 which shows a screw gun 10 as illustrated in FIGS. 1 to 5 to which a driver attachment 112 is secured. The driver attachment 112 is adapted to receive a collated screwstrip 114 with spaced screws 116 to be advanced by the driver attachment 112, located in alignment with a screwdriver bit and subsequently driven into a workpiece on the user urging the screw gun 10 into a workpiece. The structure of the preferred driver attachment 112, shown in FIG. 6, is described below with reference to FIGS. 8, 9, 10, 11 and 12.

In overview, the driver attachment 112 has a rearwardly directed socket 127 complementary to the cylindrical surface 82 on the screw gun for coupling of the driver attachment 112 to the screw gun and with a driver shaft 134 to be received in the hex coupling 22. The driver attachment has a housing 118 which is secured to the housing 12 of the screw gun via the socket 127. A slide body 120 is slidable relative the housing coaxially about the drive shaft 134 for reciprocal inward and outward movement and is biased by a spring 138 outwardly away from the housing 118. The slide body carries a guide mechanism for guiding screws in the screw strip into and maintaining a screw to be driven in axial alignment with the drive shaft 134 and a mechanism for successively advancing screws in the screw strip.

The tool shown in FIG. 6 comprises a combination in which the screw gun 10 and driver attachment 112 are complementarily chosen having regard to their relative mass and proportion and, preferably, also the mass and proportion of the screw strip 114 such that the geometric center of mass of the combined tool, as seen in side view, will occur between the dashed lines identified as 90 and 91 in FIG. 6 and, preferably, proximate the intermediate handle-forming portion 48 and, more preferably, proximate axis 40. Line 90 is intended to represent a line on which the center of mass may reside when the screw strip 114 is full of screws and line 92 when the screw strip is empty of screws.

As well, the tool shown in FIG. 6,is configured such that if viewed in rear view similar to that of FIG. 4, the geometric center of mass would effectively be located in or proximate to the flat plane containing both axis 40 and motor axis 16 about which plane the screw gun 10 is preferably, effectively symmetrical. The driver attachment 112 is secured to support surface 82 oriented such that screw strip 114 extends as a preferred straight, relatively rigid strip, vertically downward, centrally through feed channel element 176. As lead screw 117 is aligned with the axis 40, the screw strip extends vertically downward therefrom each screw 116 and, therefore, effectively, the screw strip 114 is symmetrical about the same flat plane containing both axis 40 and motor axis 16.

Such weight symmetry of the entire tool including the screw strip about a central plane passing centrally through the handle-forming portion 48 is of assistance in reducing fatigue caused to a user's hand and arm which might otherwise arise if the tool is weighted to one side of this plane as in applying forces necessary to keep the central plane of the tool in a generally vertical position. The weight symmetry with the tool, as shown in FIG. 6, and the finite screw strip 114 hanging vertically downwardly is a particularly preferred configuration for driving screws horizontally into workpieces such as applying drywall to walls and the present invention includes a method of driving threaded fasteners horizontally into workpieces with tools having such a configuration. Preferably, each of the screw gun 10, driver attachment 112 and screw strip 116 are selected, to have configurations such that their mass is symmetrical about a central vertical plane as seen in FIG. 6. While the particular weight and configuration of the screw gun 10, its motor 16 and the driver attachment 112 will have a major bearing on the ability to configure a combination tool with a center of gravity at any particular location, as seen in side view in FIG. 6, the selection of the screw gun and driver attachment 112 with the screw strip 114 to extend vertically downwardly therefrom, can independently permit substantial location of the center of gravity on a vertical central plane.

The tool of FIG. 6 illustrates a combination of a screw gun 10 with a removable driver attachment 112. It is to be appreciated that an integral tool dedicated to driving collated screws may be manufactured rather than provide the tool as two principal, separable components.

FIG. 6 illustrates driver attachment 112 utilizing collated screws on a screw strip of finite length and in which the screw strip is preferably relatively rigid and self-supporting. Such lengths of screw strips could be provided, for example, one or two feet long and can be manually fed into the driver attachment 112 when desired. In the preferred configuration shown in FIG. 6, the initial length of the strip preferably does not extend a distance measured perpendicular the takeoff axis 40 beyond the lowermost portion of the first housing portion 44.

Figure 11:
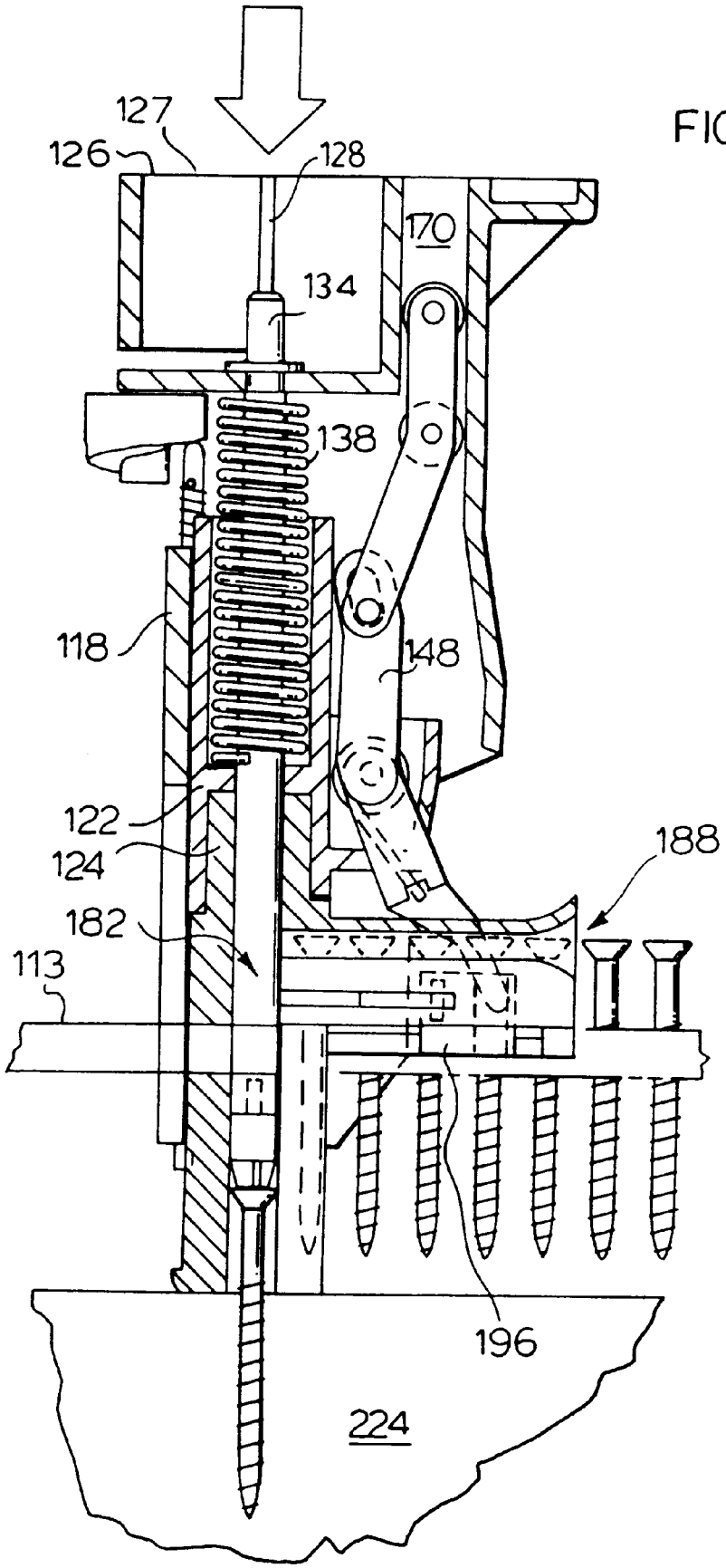
FIG. 11 is a view identical to FIG. 10 but with the driver attachment in a partially retracted position in driving a screw into a workpiece.
Figure 12:
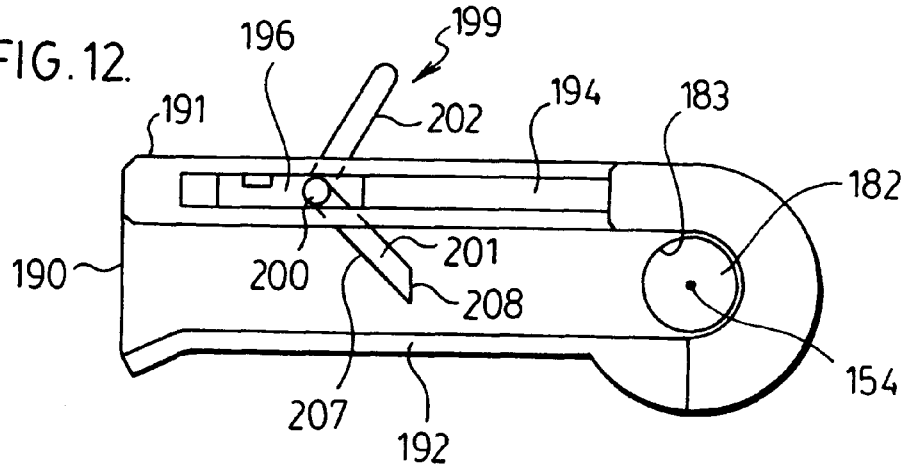
FIG. 12 is an end view of the nose portion of FIG. 8.
Figure 13:
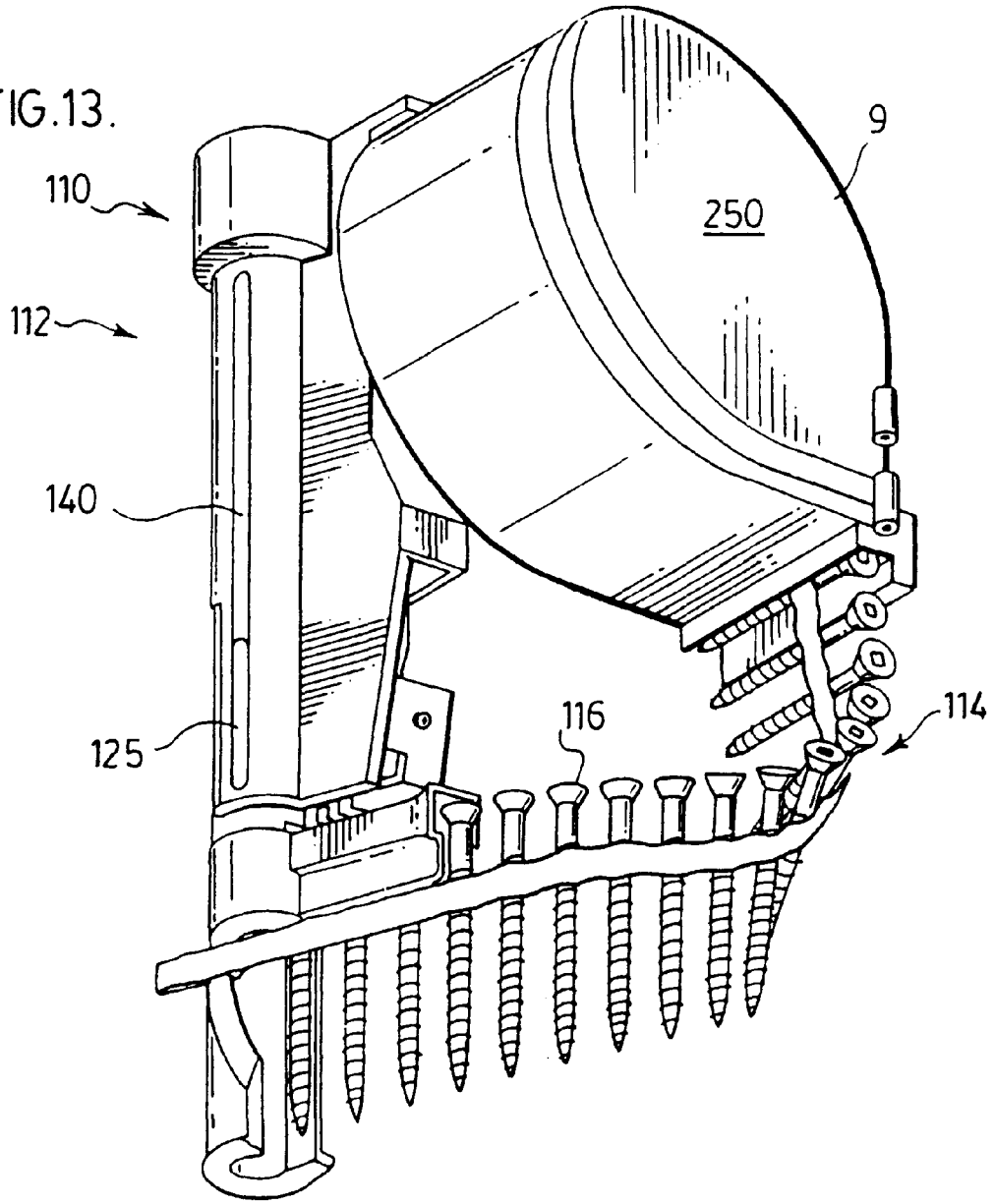
FIG. 13 is a pictorial view of the driver attachment of FIG. 8 carrying a screw coiling cannister.

Reference is now made to FIG. 13 which shows the same driver attachment 112 as shown in FIGS. 8 to 12 but, however, with a known cartridge 9 attached which has a hinged door 250 permitting the insertion of a coil of a more flexible form of the screw strip 114 containing, for example, up to 1,000 screws.

It is to be appreciated that many other driver attachments of different types than those illustrated may be utilized. Known driver attachments for driving collated screw strips include those taught by U.S. Pat. No. 4,146,871 to Mueller et al, issued Mar. 27, 1995 and those taught by the earlier referenced patents referred to in the background of the invention of this application.

The driver attachment 112 illustrated in FIGS. 6 and 7 to 13 is preferably for use in driving collated screw strips. Collated screw strips are known in which the screws connected to each other by a retaining strip of plastic material. Preferred strips are taught, for example, by U.S. Pat. No. 4,167,229, issued Sep. 11, 1979 and its related Canadian Patents 1,040,600 and 1,054,982 as well as U.S. Pat. No. 4,930,630. Driver attachment adapted to drive other collated screws and/or individual screws and/or other thread fasteners and the like may also be used in accordance with a power tool in accordance with the present invention.

Figure 7:
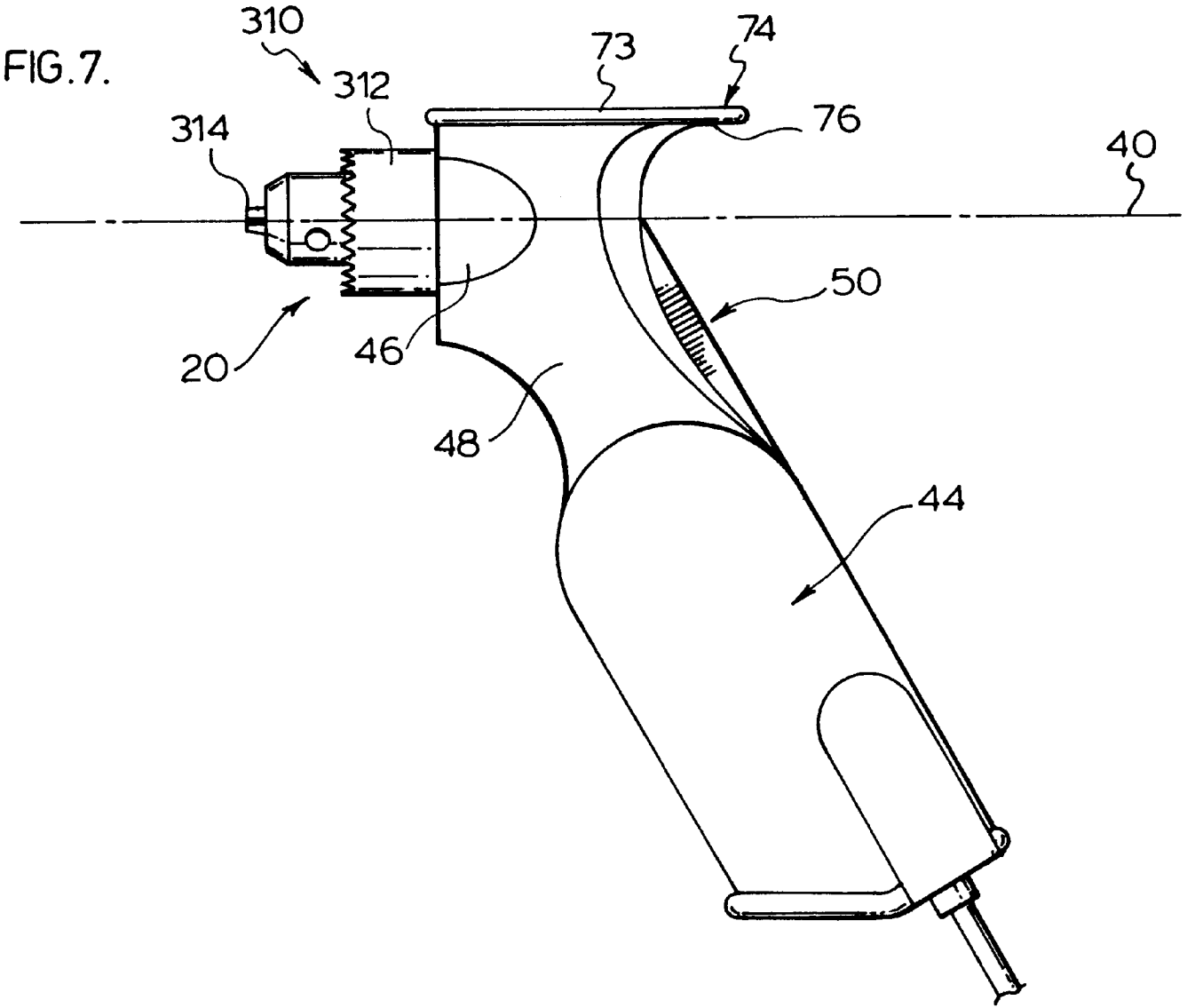
FIG. 7 is a side view of a power drill similar to the screw gun of FIGS. 1 to 5.

FIG. 7 shows a power tool generally indicated as drill 310 which is identical to the screw gun 10 of FIGS. 1 to 4, however, has a modified takeoff mechanism 20 which comprises a conventional chuck 312 as provided on known drills and is adapted to engage and receive drill bits and the like which are to be rotated. It is to be appreciated that the power drill is useful for rotating many known tools such as screwdriver bits, rotary metal files, circular sanding blocks, countersink devices, and the like. It is well known that the chuck 312 includes complementary internally positionable fingers 314 which are adapted to engage cylindrical and/or faceted shafts of bits and the like of varying sizes and to clamp them in place within the chuck for rotation parallel the takeoff axis 40.

The power tool in accordance with the present invention includes, as preferred embodiments, tools in which the takeoff mechanism provides for rotation about takeoff axis 40. The manner of powering the motor 14 may include many systems including electrical motors powered by AC power from a cord and/or electrical motors powered by batteries. The first housing portion 44 for the motor could also provide a storage location for batteries.

The invention has been illustrated with reference to power tools in which the power takeoff provides a rotary motion about the power takeoff axis 40. The invention is not so limited and the takeoff mechanism could provide for other power takeoff modes such as for vibratory and/or orbital motion sanders and/or belt sanders, reciprocating or rotating saws, crimping devices and metal nibbling devices and scissors and shears and other cutting devices and the like.

DRIVER ATTACHMENT

Figure 8:
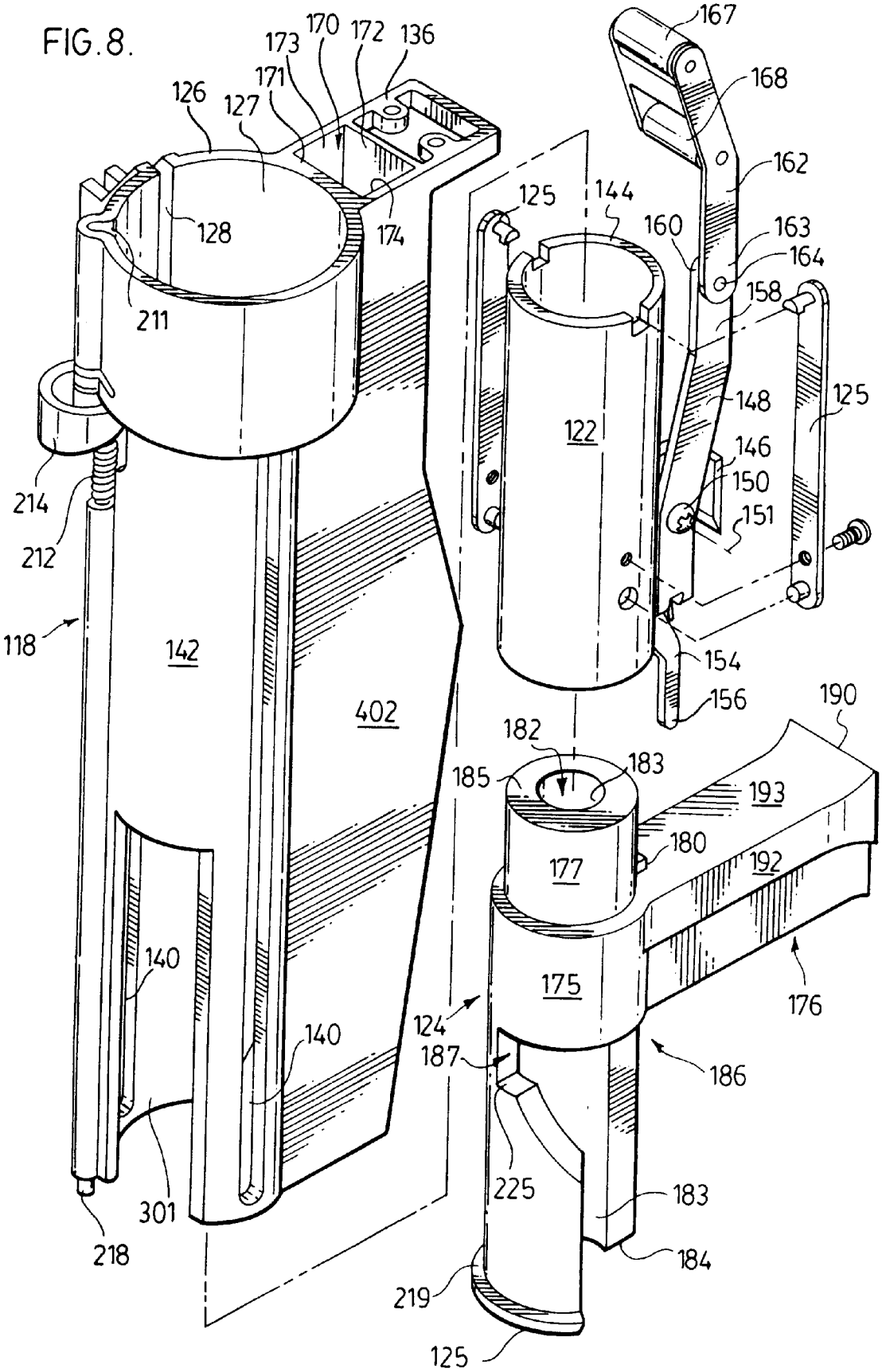
FIG. 8 is an exploded pictorial view of the driver attachment shown in FIG. 6.
Figure 10:
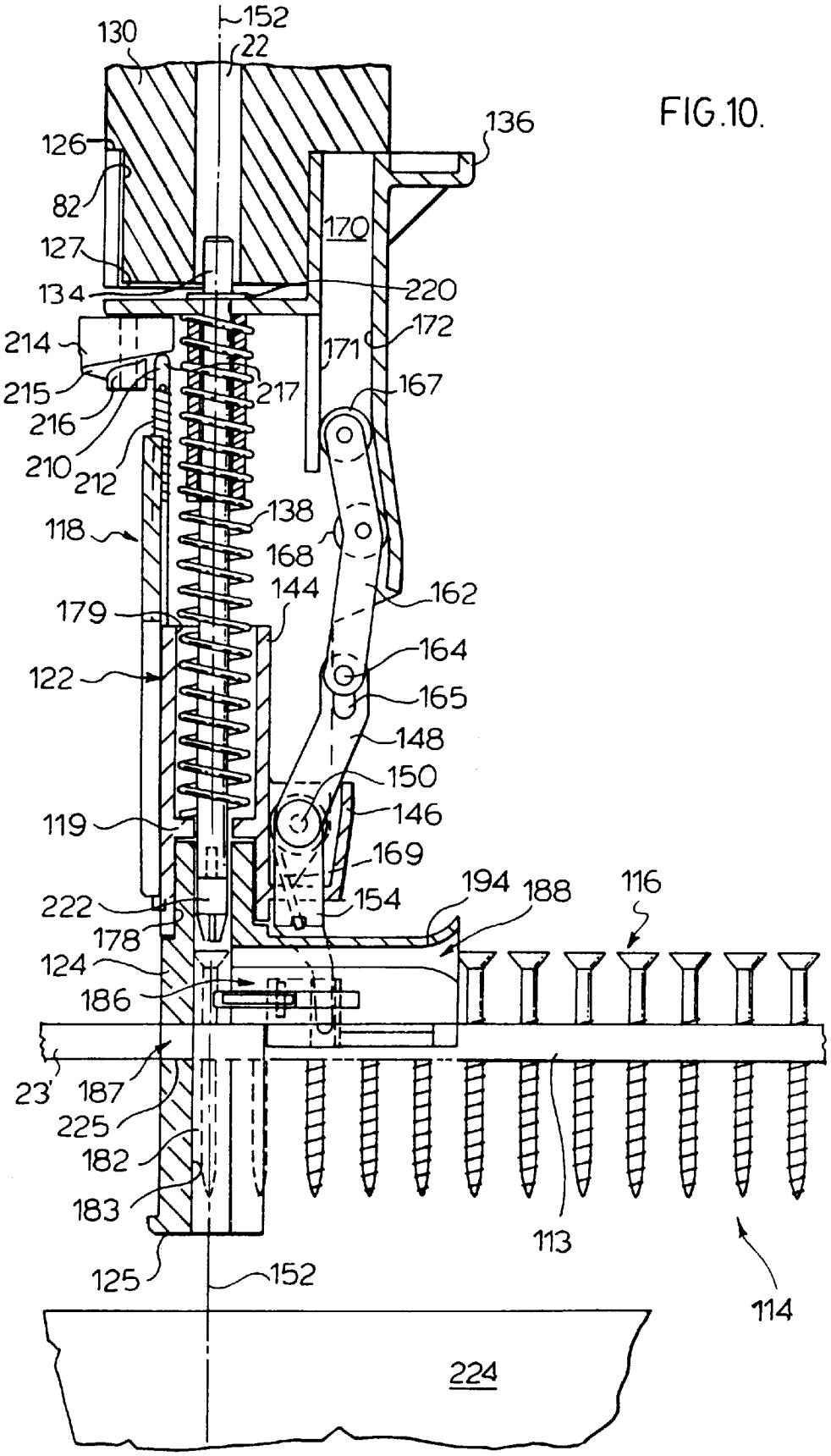
FIG. 10 is a schematic partially cross-sectional view of the driver attachment of FIG. 8 in a fully extended position as seen in FIG. 8 to a plane passing through a longitudinal axis of the drive shaft and centrally of the screws in the screw strip.

Reference is made to FIG. 8 showing an exploded view of major components of the driver attachment 112 as housing 118 and a slide body comprising a rear portion 122 and a removable nose portion 124. FIGS. 10 and 11 show in cross-section the interaction of these components.

As seen in FIG. 10, the rearmost end 126 of the housing 118 has a rearwardly directed socket 127 with a longitudinal slot 128 in its side wall to receive and securely clamp the housing 118 onto the cylindrical surface 82 of housing 12 of the screw gun 10 so as to secure the housing 118 of the driver attachment to the housing 12 of the screw gun against relative movement. The hex coupling 22 of the screw gun releasably engages a hexagonally shaped end of the driver shaft 134 in known manner. The housing 118 is provided with a lateral flange 136 at its rear end to which a known screw strip containing cartridge 119 may optionally be secured in a conventional manner as shown in FIG. 10.

As seen in FIG. 10, the slide body 120 is slidably received in the housing 118 with the driver shaft 134 received in a bore passing through the rear portion 122 and nose portion 124 of the slide body 120. A compression spring 138 disposed between the housing 118 and the rear portion 122 coaxially about the driver shaft 134 biases the slide body away from the housing 118 from a retracted position towards an extended position. As shown, the spring 138 is disposed between the housing 118 and the rear portion 122. Slide stops 125, best shown in FIG. 8, are secured to the rear portion 122 of the slide body. Two slide stops 125 slide in two longitudinal slots 140 on each side of the part cylindrical side wall 142 of the housing 118 to key the rear portion 122 of the slide body to the housing 118 against relative rotation and to prevent the slide body being moved out of the housing 118 past a fully extended position.

The rear portion 122 comprises a generally cylindrical element 144 with a radially extending flange element 146 on one side. A lever 148 is pivotally mounted to the flange element 146 by bolt 150 normal to a longitudinal axis 152 which passes centrally through the drive shaft 134 and about which the drive shaft is rotatable. Lever 148 has a forward arm 154 extending forwardly to its front end 156 and a rear arm 158 extending rearwardly to its rear end 160. A cam follower 162 has its forward end 163 mounted to the rear end 160 of the rear arm 158 by a bolt 164 being received in a slot 165 extending longitudinally in the rear end of the rear arm 158. The cam follower 162 has at its rear end 166 two cam rollers 167 and 168 rotatable on pins parallel to the axis of bolts 150 and 164.

As seen in FIGS. 8 and 10, the housing 118 carries a camming channel 170 in which the cam rollers 167 and 168 are received. The camming channel 170 is disposed to one side of the driver shaft 134 and extends generally parallel thereto. The camming channel 170 has opposed camming surfaces 171 and 172 at least partially closed by side walls 173 and 174.

The camming channel 170 extends rearwardly beside the socket 127 of housing 118 and, thus, rearwardly past the cylindrical support surface 82 of the screw gun 10 to one side thereof. This configuration permits the use of a housing 118 which is of a lesser length parallel longitudinal axis 152 for a given length of the cam follower 162 and of the lever 148, rearward of bolt 150.

A spring 169 wound about bolt 150 is disposed between the flange element 146 and the forward arm 154 of the lever 148 to bias the lever in a clockwise direction as seen in FIG. 10. The effect of spring 169 is to urge the cam roller 167 into engagement with cam surface 171 and to urge cam roller 168 into engagement with cam surface 172.

With relative sliding of the slide body 120 and the housing 118 between the extended and the retracted positions, the cam follower 62 translates the relative movement and positioning of the slide body 120 and housing 118 into relative pivoting and positioning of the lever 48 about the axis 151. The ability of bolt 164 to slide longitudinally in the longitudinal slot 65 provides a lost motion linkage as is known and has advantages such that the relative timing of pivoting of the lever 148 varies as compared to the relative location of the slide body 120 and housing 118 in moving towards an extended position as contrasted with moving towards a retracted position.

The nose portion 124 has a generally cylindrical screw guide element or guide tube 175 arranged generally coaxially about longitudinal axis 152 and a flange-like screw feed channel element 176 extending radially from the guide tube 175.

The guide tube 175 has a cylindrical portion 177 at its rear end with a cylindrical exterior surface sized to be closely received, preferably in a friction fit, within a forwardly opening cylindrical bore 178 in the forward end of the rear portion 122. A radially extending key 180 is provided to extend from the cylindrical portion 177 of the nose portion 124 to be received in a correspondingly sized keyway slot 182 in the rear portion 122 as best seen in FIG. 10 to secure the nose portion 124 to the rear portion 122 against relative pivoting about the longitudinal axis 152.

The guide tube 175 has a cylindrical bore or guideway 182 extending axially through the guide tube with the guideway 182 delineated and bordered by a radially extending cylindrical sidewall 183 and open at its forward axial end 184 and at its rearward axial end 185.

The guide tube 175 has a rearward section adjacent its rear end 185 in which the side wall 183 extends 3600 about the guideway 182. Forward of the rearward section, the guide tube has a forward section best seen in FIG. 10 and which has an access opening 86, shown in the drawings as being on the right hand side of the guide tube 175. Screw access opening 186 is provided to permit the screw strip 114 including retaining strip 113 and screws 116 to move radially inwardly into the guideway 182 from the right as seen in FIGS. 10 and 11. Each screw, preferably, has a head 117 with a diameter marginally smaller than the diameter of the side wall 183. It follows that where the head of the screw is to enter the guideway 182, the screw access opening must have a circumferential extent of at least 180°. Where the shank 208 of the screw is to enter the guideway, the screw access opening may have a lesser circumferential extent.

In the forward section, the side wall 183 of the guide tube 175 engages the radially outermost periphery of the head 117 of the screw 116, to axially locate the screw head 117 coaxially within the guideway 182 in axial alignment with the drive shaft 134. In this regard, the side wall 183 preferably extends about the screw sufficiently to coaxially locate the screw head and thus, preferably, extend about the screw head at least 120°, more preferably, at least 150° and, most preferably, about 180°.

An exit opening 187, shown towards the left hand side of the guide tube 175 in FIGS. 10 and 11, is provided of a size to permit the spend plastic strip 113 from which the screws 116 have been driven to exit from the guideway 182. Forwardly of the exit opening 187, the side wall 183 of the guide tube 175 is shown as extending greater than about 180° about the longitudinal axis 152 so as to continue to provide a side wall 183 which can assist and positively coaxially guiding the head 117 of a screw 116 being driven.

Figure 9:
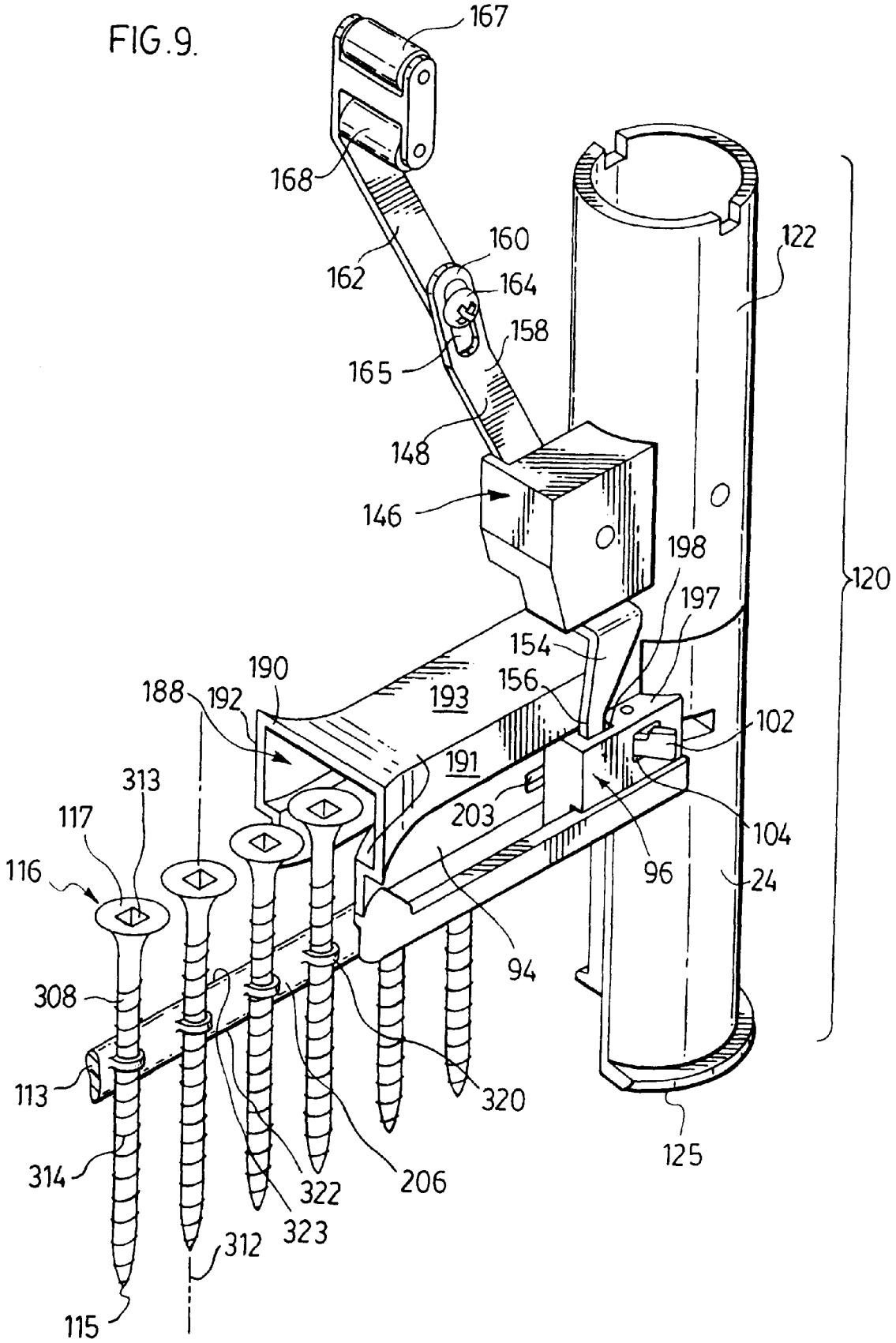
FIG. 9 is a pictorial view of the opposite side of the slide body of the driver attachment shown in FIG. 8 but with a screw strip positioned therein.

The screw feed channel element 176 is best seen in FIGS. 9 and 10 as providing a channelway 188 which extends radially relative the longitudinal axis 152 to intersect with the guideway 182 in the guide tube 175. In this regard, the channelway 188 opens to the guideway 182 as the screw access opening 186. The channelway 188 provides a channel of a cross-section similar to that of the screw access opening 186 from the screw access opening 186 to a remote entranceway opening 190. The channelway 188 is defined between two side walls 191 and 192 joined by a top wall 193. The major side wall 191 is shown as extending from the heads 117 of the screws 116 forwardly to at least partially behind the plastic retaining strip 113. The lesser side wall 192 is shown as extending from the heads 117 of the screws 116 forwardly to above the plastic strip 113. The side walls 191 and 192 define the channelway 188 with a cross-section conforming closely to that of the screw strip 114 and its strip 113 and screws 116 with an enlarged width where the heads of the screws are located and an enlarged width where the retaining strip 113 is provided about the screws. The side walls 191 and 192 also have a enlarged funnelling section at the entranceway opening 190 which tapers inwardly to assist in guiding the screw strip to enter the channelway.

As best seen in FIG. 9, the major side wall 191 is provided on its exterior back surface with a raceway 194 extending parallel the channelway 188 and in which a shuttle 196 is captured to be slidable towards and away from the guide tube 175 between an advanced position near the guide tube and a withdrawn position remote from the guide tube. The shuttle 196 has a rear surface 197 in which there is provided a rearwardly directed opening 198 adapted to receive the front end 156 of the forward arm 154 of lever 148 so as to couple the shuttle 196 to the lever 148 for movement therewith.

Shuttle 196 carries a pawl 199 to engage the screw strip 114 and with movement of the shuttle 196 to successively advance the strip one screw at a time. As seen in FIG. 12, the shuttle 196 has a fixed post 200 on which the pawl 199 is journalled about an axis parallel the longitudinal axis 152 about which the driver shaft 34 rotates. The pawl 199 has a strip pusher arm 201 which extends through a slot 203 in the major side wall 191 to engage and advance the screw strip. The pawl 199 has a manual release arm 202 away from pusher arm 201 and which extends out through a slot 204 in the shuttle 199. A torsional spring is disposed about post 200 between pawl 199 and shuttle 196 and urges the pusher arm 201 clockwise as seen in FIG. 12. The spring biases the pusher arm 201 into the screw strip 114. The engagement of release arm 202 on the right hand end of slot 204 limits the pivoting of the pawl 199 clockwise to the position shown in FIG. 12.

The pusher arm 201 of the pawl 199 has a cam face 207. On the shuttle moving away from the guide tube 175 towards the withdrawn position, i.e., to the left in FIG. 12, the cam face 207 will engage the screws 116 and/or the strip 113 and permit the pusher arm 201 to pivot about post 200 against the bias of spring so that the pusher arm 201 may move with the shuttle to the left.

The pusher arm 201 has an engagement face 208 to engage the screws 116 and/or strip 113. On the shuttle moving towards the guide tube 175 towards the advanced position, i.e., to the right in FIG. 12, the engagement face 208 will engage the screws 116 and/or strip 113 and advance the screw strip to the right as seen in FIG. 12 so as to position a screw 116 into the guideway 182 in a position to be driven and to hold the screw strip 114 against movement towards the left.

The release arm 202 permits manual withdrawal of the screw strip 114. A user may, with his finger or thumb, manually pivot the release arm 202 against the bias of spring so that the pusher arm 201 and its engagement face 208 is moved away from and clear of the screw strip 114 whereby the screw strip may manually be withdrawn as may be useful to clear jams or change screw strips.

With the nose portion 124 coupled to the rear portion 122, the lever 148 couples to the shuttle 196 with the forward arm 154 of lever 148 received in the opening 198 of the shuttle 196. Sliding of the slide body 120 and the housing 118 in a cycle from an extended position to a retracted position and then back to an extended position results in reciprocal pivoting of the lever 148 about axis 151 which slides the shuttle 196 between the advanced and withdrawn position in its raceway 194 and hence results in the pawl 199 first retracting from engagement with a first screw to be driven to behind the next screw 116 and then advancing this next screw into a position to be driven.

The nose portion 124 is removable from the rear portion 122. The nose portion 124 and rear portion 122 may be coupled together by axially inserting the cylindrical portion 77 of the guide tube 175 into the bore 178 in the rear portion 122 with the key 180 aligned with the keyway slot 182 and with the front end 156 of the forward arm 154 of the lever 248 aligned with the opening 198 in the shuttle 196. Thus, the removable nose portion 124 may be coupled to the rear portion 122 merely by axially aligning the nose portion and the rear portion and moving the two elements together in a direction parallel the longitudinal axis 152.

With the nose portion 124 held on the rear portion 122 by a friction fit, the nose portion 124 can manually be removed by a user merely by the manual application of force. The nose portion 124 is removable from the rear portion 122 without disassembly or uncoupling of any of the remainder of the screwdriver assembly 110. Thus, the nose portion 124 is removable without uncoupling of the rear portion 122 relative any of the housing 118, spring 138, screw gun 10, driver shaft 134 or the screw feed activation mechanism comprising, amongst other things, the lever 148 and cam follower 162 and without uncoupling of the cam follower 162 in camming channel 170 of the housing 118.

The nose portion 124 carries the guide tube 175 with its screw locating guideway 182, the screw feed channel element 176 with its channelway 188, and screw feed advance mechanism with the reciprocating shuttle 196 and pawl 199 to advance the screw strip 114 via the channelway 188 into the guideway 182. Each of the guideway 182, channelway 88 and shuttle 196 are preferably customized for screw strips and screws or other fasteners of a corresponding size. In this context, size includes shape, head diameter, shaft diameter, retaining strip configuration, length, spacing of screws along the retaining strip and the presence or absence of washers, amongst other things. Different nose portions 124 are to be configured for different screw strips and screws. The different nose portions 124 are each compatible with the same rear portion 122 and are readily exchangeable so as to permit the driver attachment to be readily adapted to drive different screw strips and screws.

Many changes can be made to the physical arrangement of the nose portion 124 to accommodate different screws and fasteners. For example, the cross-sectional shape of the channelway 188 can be changed as can the diameter of the guideway 182. The length of the side walls 191 and 192 about the channelway 188 can be varied to accommodate different size screws which may require greater or lesser engagement.

To adjust for different spacing between screws in different screw strips, the stroke of the shuttle 196 in reciprocating back and forth can be shortened or lengthened by varying the distance from the axis 151 of the lever 148 to where the shuttle 196 engages the forward arm 154 of the lever 148. For example, placing the same shuttle 196 in a raceway 194 spaced further from the axis 151 will increase the length of the stroke of the shuttle 196 for the same arc of pivoting of lever 148. Similarly, using the same shuttle 196 in the same raceway 194 but having the opening 198 in the shuttle 196 to engage the lever 148 farther from the axis 151 will also increase the length of the stroke of the shuttle 196 for the same arc of pivoting of lever 148.

In contrast with the removable nose portion 124 which is intended to be provided in many different replaceable configurations, the remainder of the driver attachment is preferably of a constant unchanged configuration. In this regard, the remainder of the driver attachment may be characterized by the housing 118, rear portion 122 of the slide body 120, drive shaft 134 and spring 138 together with a screw feed activation mechanism comprising the lever 148 and cam follower 162 interacting between the rear portion 122 and the housing 118. This screw feed activation mechanism is activated by relative movement of the housing 118 and rear portion 122 and serves to engage and move the screw feed advance mechanism comprising the shuttle 196 and pawl 199 carried on the nose portion 124.

The construction of the housing 118 and slide body 120 provide for a compact driver attachment.

The housing 118 has a part cylindrical portion formed by side wall 401.

The slide body 120, as been seen in FIG. 9, comprising the rear portion 122 and nose portion 124, has a part cylindrical portion of a uniform radius sized to be marginally smaller than the sidewall 401 of the housing 118. The side wall 401 extends circumferentially about the part cylindrical portion of the slide body 120 to retain the slide body 120 therein.

The housing has a flange portion 402 which extends radially from one side of the part cylindrical portion and is adapted to house the radially extending flange 146 of the rear portion 122 and the screw feed activation mechanism comprising the camming channel 170 interacting with the lever 148 and cam follower 162. The flange portion 402 is open at its front end and side to permit the screw feed channel element 176 to slide into and out of the housing 118. Concentrically located about the drive shaft 134 is the spring 138, the part cylindrical portions of the slide body 120, and the part cylindrical portions of the housing 118.

The driver attachment is provided with an adjustable depth stop mechanism which can be used to adjust the fully retracted position, that is, the extent to which the slide body 120 may slide into the housing 118. The adjustable depth stop mechanism is best seen in FIGS. 8 and 9 as comprising an elongate rod 210 slidably received in an elongate open ended bore 211 provided in the side wall 142 of the housing 118 and extending parallel to longitudinal axis 152.

A depth setting cam member 214 is secured to the housing 118 for rotation about a pin 216 parallel the longitudinal axis 152. The cam member 214 has a cam surface 215 which varies in depth, parallel the longitudinal axis 152, circumferentially about the cam member 214. A portion of the cam surface 215 is always axially in line with the rod 210. A spring 212 biases the rod 210 rearwardly such that the rear end 217 of the rod engages the cam surface 215. The spring 212 is disposed between the housing and a pin 213 on the rod. By rotation of the cam member 214, the extent to which the rod 210 may slide rearwardly is adjusted.

The rod 210 has a front end 218 which extends forwardly from bore 211 for engagement with a rearwardly directed annular stop surface 219 provided on the nose portion 124 of the slide body. The slide body 120 is prevented from further sliding into the housing 118 when the front end 218 of the rod 210 engages the stop surface 219. The extent the slide body 120 may slide into the housing 118 is determined by the length of the rod 210 and the depth of the cam member 214 axially in line with the rod. The cam member 214 is preferably provided with a ratchet-like arrangement to have the cam member 214 remain at any selected position biased against movement from the selected position and with circular indents or depressions in the cam surface 215 to assist in positive engagement by the rear end 217 of the rod. The cam member 214 is accessible by a user, yet is provided to be out of the way and not interfere with use of the driver attachment. The nose portion 124 may be customized for use in respect of different size screws by having the location of the stop surface 219 suitably provided axially on the nose portion 124 as may be advantageous for use of different size screws.

The driver shaft 134 is shown in FIGS. 10 and 11 as carrying a split washer 220 engaged in an annular groove near its rear end 221 to assist in retaining the rear end of the driver shaft in the socket 127 of the housing 118. The driver shaft 134 is provided with a removable bit 222 at its forward end which bit can readily be removed for replacement by another bit as for different size screws. Such bits include sockets and the like and any replacement bits will preferably be of an outside diameter complementary to the inside diameter of the guideway 182 in a corresponding replacement nose portion adapted for use with the corresponding sized screws. To accommodate bits of increased diameter over the bit shown in FIGS. 10 and 11, the guideway 182 of the guide tube 175 may be provided with an increased radius, at least commencing at the location where the bit may have an enlarged diameter and extending forwardly therefrom. The guideway 182 in the guide tubes 175 may thus have a step configuration with the side wall 183 being of a reduced diameter where the driver shaft 134 enters the rear of the guide tube 175 and the side wall 183 may then increase to an enlarged diameter forwardly to accommodate an enlarged bit such as a socket.

The rear portion 122 is shown in FIGS. 10 and 11 as having a radially inwardly extending annular flange 119 which provides the end of the forwardly opening bore 178 as well as the end of a rearwardly opening bore 179 within which the spring 138 is received. The annular flange 119 has an opening therethrough of a diameter slightly larger than the diameter of the driver shaft 134 so as to assist in journalling the driver shaft therein. The opening through the annular flange 119 may, however, be increased so as to facilitate the use of driver shafts 134 having enlarged diameters as well as driver shafts 134 having reduced diameters.

Insofar as the driver shaft 134 has a removable bit 222, it is preferred that, as shown, when the driver attachment 112 is in the fully extended position and the nose portion 124 is removed, the bit 222 be readily accessible for removal and replacement. In this regard, it is preferred that the nose portion 224 have a guideway 182 of a minimum diameter throughout its length at least equal to the diameter of the bit 222 such that the nose portion 124 may be removed from the rear portion 222 without the need to remove the bit 222 as may otherwise be the case in the event the guideway 182 may have a stepped configuration.

Operation of the driver attachment is now explained with particular reference to FIGS. 10 and 11. As seen in FIG. 10, the screws 116 to be driven are collated to be held parallel and spaced from each other by the plastic retaining strip 113.

In operation, a screw strip 114 containing a number of screws 116 collated in the plastic retaining strip 113 is inserted into the channelway 188 with the first screw to be driven received within the guideway 182. To drive the first screw into the workpiece 224, the power driver 110 is activated to rotate the driver shaft 134. The driver shaft 134 and its bit 222, while they are rotated, are reciprocally movable in the guideway 182 towards and away from the workpiece 224. In a driving stroke, manual pressure of the user pushes the housing 118 towards the workpiece 224. With initial manual pressure, the forward end 125 of the nose portion engages the workpiece 224 to compress spring 138 so as to move slide body 120 relative the housing 118 into the housing 118 from an extended position shown in FIG. 10 to a retracted position. On release of this manual pressure, in a return stroke, the compressed spring 138 moves the slide body 120 back to the extended position thereby moving the housing 118 and the driver shaft 134 away from the workpiece.

In a driving stroke, as the driver shaft 134 is axially moved towards the workpiece, the bit 222 engages the screw head 117 to rotate the first screw to be driven. As is known, the plastic strip 113 is formed to release the screw 116 as the screw 116 advances forwardly rotated by the driver shaft 134. Preferably, on release of the screw 116, the plastic strip 113 deflects away from the screw 116 outwardly so as to not interfere with the screw 116 in its movement into the workpiece. After the screw 116 is driven into the workpiece 224, the driver shaft 134 axially moves away from the workpiece under the force of the spring 138 and a successive screw 116 is moved via the screw feed advance mechanism from the channelway 188 through the access opening 186 into the guideway 182 and into axial alignment in the guideway with the driver shaft 134.

The screw 116 to be driven is held in position in axial alignment with the driver shaft 134 with its screw head 117 abutting the side wall 183 in the guideway 182. As a screw 116 to be driven is moved into the cylindrical guideway 182, a leading portion of the strip 113' from which screws have previously been driven extends outwardly from the guideway 183 through the exit opening 187 permitting substantially unhindered advance of the screw strip 114.

To assist in location of a screw to be driven within the guide tube 175, in the preferred embodiment the exit opening 187 is provided with a rearwardly facing locating surface 225 adapted to engage and support a forward surface 222 of the strip 113. Thus, on the bit 222 engaging the head of the screw and urging the screw forwardly, the screw may be axially located within the guide tube 175 by reason no only of the head of the screw engaging the side wall 183 of the guideway but also with the forward surface 322 of the strip 113 engaging the locating surface 225 of the exit opening 187. In this regard, it is advantageous that the forward surface 322 of the retaining strip 113 be accurately formed having regard to the relative location of the screws 116 and, particularly, the location of their heads 117. The forward surface 322 of the strip 113 may be complementary formed to the locating surface 225 and, if desired, indexing notches or the like may be provided in the forward surface 322 of the strip 113 to engage with complementary notches or indents on the locating surface 225 of the entranceway to assist in indexing location of the strip 113 relative the locating surface and enhance the location thereby of the screw 116 within the guide tube 175.

A preferred collated screw strip 114 for use in accordance with the present invention is as illustrated in the drawings and, particularly, FIG. 9 and are substantially in accordance with Canadian Patent 1,054,982. The screw strip 114 comprises a retaining strip 113 and a plurality of screws 116. The retaining strip 113 comprises an elongate thin band formed of a plurality of identical sleeves interconnected by lands 206. A screw 116 is received within each sleeve. Each screw 116 has a head 117, a shank 308 carrying external threads 314 and a tip 115. As shown, the external threads extend from below the head 117 to the tip 115.

Each screw is substantially symmetrical about a central longitudinal axis 312. The head 117 bas in its top surface a recess 313 for engagement by the screwdriver bit.

Each screw is received with its threaded shank 308 engaged within a sleeve. In forming the sleeves about the screw as in the manner, for example, described in Canadian Patent 1,040,600, the exterior surfaces of the sleeves come to be formed with complementary threaded portions which engage the external thread 314 of the screw 116. Each sleeve has a reduced portion between the lands 306 on one first side of the strip 113. This reduced strength portion is shown where the strip extends about each screw merely as a thin strap-like portion or strap 320.

The strip 113 holds the screw 116 in parallel spaced relation a uniform distance apart. The strip 113 has a forward surface 322 and a rear surface 323. The lands 206 extend both between adjacent screws 116, that is, horizontally as seen in FIG. 9, and axially of the screws 116, that is, in the direction of the longitudinal axes 312 of the screws. Thus, the lands comprise webs of plastic material provided over an area extending between sleeves holding the screws and between the forward surface 322 and the rear surface 323. A land 306 effectively is disposed about a plane which is parallel to a plane in which the axes 312 of all the screws lies. Thus, the lands 306 comprise a web which is disposed substantially vertically compared to the vertically oriented screws as shown in the figures. The lands 306 and the sleeves, in effect, are disposed as a continuous, vertically disposed strip 113 along the rear of the screws 116, that is, as a strip 113 which is substantially disposed about a plane which is parallel to a plane containing the axes of all screws.

A preferred feature of the screw strip 114 is that it may bend to assume a coil-like configuration due to flexibility of the lands 306 such that, for example, the screw strip could be disposed with the heads of the screws disposed into a helical coil, that is, the plane in which all the axes 312 of the screws lie may assume a coiled, helical configuration to closely pack the screws for use. Having the lands 306 and sleeves as a vertically extending web lying in the plane parallel that in which the axes 312 permits such coiling.

The invention is not limited to use of the collated screw strips illustrated. Many other forms of screw strips may be used such as those illustrated in U.S. Pat. Nos. 3,910,324 to Nasiatka; 5,083,483 to Takagi; 4,019,631 to Lejdegard et al and 4,018,254 to Decarlo.

While the invention has been described with reference to preferred embodiments, many modifications and variations of the invention will now occur to those persons skilled in the art. For definition of the invention, reference is made to the appended claims.

I claim:

1. A hand held power tool selected from a power drill and a power driver comprising:

an elongate housing with a first forward end portion, an intermediate handle-forming portion and a second rearward end portion, the intermediate handle-forming portion joining the first end portion and the second end portion, the first end portion carrying a power takeoff mechanism rotatable about an output axis, the first end portion generally disposed about the output axis, the second end portion carrying a motor rotatable about a motor axis, the intermediate handle-forming portion providing a pistol-grip handle adapted to be grasped by a user's hand, both the second end portion and the handle generally disposed about the motor axis with the handle comprising an extension of the second end portion, the handle having a circumference thereabout less then a circumference about the second end portion, the output axis and motor axis lying in a common plane, the output axis and motor axis intersecting to form an acute angle therebetween such that the first end portion extends at an angle relative the intermediate portion and second end portion, and with the tool in a desired position for use with the output axis horizontal, the first end portion extends horizontally forwardly from an upper end of the intermediate portion, and the handle and second end portion extend downwardly and rearwardly from a rear of the first end portion, the handle having surfaces including a rear surface and a front surface joined by two side surfaces, a rearward extension of the output axis intersecting the rear surface of the handle, a transmission mechanism enclosed by the housing extending internally through the handle to couple the motor to the power takeoff mechanism, a hand engaging support member carried by the housing above the handle and extending rearwardly of the handle and to each side of the handle, the support member presenting a downwardly directed support surface adapted for engaging uppermost surfaces of a user's hand grasping the handle, the support surface extending parallel to the output axis and generally transversely to the common plane, the support surface located relative the handle spaced upwardly from where the rearward extension of the output axis intersects the rear surface of the handle, and the support surface intersecting with the rear surface and the side surfaces of the handle and extending rearwardly and sideways from each of the rear surface and the side surfaces of the handle, the support surface extending from both side surfaces of the handle away from the common plane substantially equal distances.

2. A tool as claimed in claim 1 including a switch for switching the tool between an inoperative condition and an operative condition, the switch carried on the rear surface of the handle and movable between an extended inoperative position in which the switch extends rearwardly from the handle and a retracted operative position in which the switch is located forwardly from the extended position.

3. A tool as claimed in claim 2 wherein the switch is biased to assume the inoperative position.

4. A tool as claimed in claim 2 wherein the switch is located on the rear surface overlying a point where the rearward extension of the output axis intersects the rear surface of the handle.

5. A tool as claimed in claim 1 wherein the rear surface of the handle extends forwardly and upwardly towards the support surface.

6. A tool as claimed in claim 1 wherein the tool is a power drill and the power takeoff mechanism comprises a chuck rotatable about the output axis.

7. A tool as claimed in claim 1 wherein the tool is a power driver and the power takeoff mechanism comprises a fastener-engaging bit rotatable about the output axis.

8. A tool as claimed in claim 7 wherein the tool comprises a screwgun including a screwdriving mechanism for driving screws collated together in a screwstrip comprising a holding strip holding a plurality of screws spaced from one another in a row, the screwdriving mechanism including a screw feed mechanism and a guideway;

the screw feed mechanism adapted for advancing successive screws in a screwstrip into the guideway;

the guideway adapted for engaging each successive screw to be driven advanced by the screw feed mechanism and aligning the same coaxially with the output axis.

9. A tool as defined in claim 8 wherein the housing is symmetrical about the common plane in which the output axis and motor axis lie and the screw feed mechanism defines a pathway for advance of successive screws in a screwstrip such that an axis of each screw in a screwstrip to be advanced therein lies in said common plane.

10. A tool as defined in claim 9 in combination with a screwstrip comprising a holding strip of discrete length holding a plurality of screws in parallel relation spaced from one another in a row, wherein, with the tool disposed such that the output axis is horizontal and the common plane is vertical and with the screwstrip engaged in the screw feed mechanism, the screwstrip extends its entire length vertically downwardly from the tool with an axis of each screw in the screwstrip lying in said common plane.

11. A tool as claimed in claim 1 wherein the support surface extends to each side of the handle a distance from the common plane substantially the same as a distance the second end portion extends to each side from the common plane.

12. A tool as claimed in claim 1 wherein the support surface is symmetrical about the common plane.

13. A tool as claimed in claim 11 wherein the support surface is symmetrical about the common plane.

14. A hand held power tool selected from a power drill and a power driver comprising:

an elongate housing with a first forward end portion, an intermediate handle-forming portion and a second rearward end portion, the intermediate handle-forming portion joining the first end portion and the second end portion, the first end portion carrying a power takeoff mechanism rotatable about an output axis, the first end portion generally disposed about the output axis, the second end portion carrying a motor rotatable about a motor axis, the intermediate handle-forming portion providing a pistol-grip handle adapted to be grasped by a user's hand, both the second end portion and the handle generally disposed about the motor axis with the handle comprising an extension of the second end portion, the handle having a circumference thereabout less than a circumference about the second end portion, the output axis and motor axis lying in a common plane, the output axis and motor axis intersecting to form an acute angle therebetween such that the first end portion extends at an angle relative the intermediate portion and second end portion, and with the tool in a desired position for use with the output axis horizontal, the first end portion extends horizontally forwardly form an upper end of the intermediate portion, and the handle and second end portion extend downwardly and rearwardly from a rear of the first end portion, the handle having surfaces including a rear surface and a front surface joined by two side surfaces, a rearward extension of the output axis intersecting the rear surface of the handle, a transmission mechanism enclosed by the housing extending internally through the handle to couple the motor to the power takeoff mechanism, a hand engaging support member carried by the housing above the handle and extending rearwardly of the handle and to each side of the handle, the support member presenting a downwardly directed support surface adapted for engaging uppermost surfaces of a user's hand grasping the handle, the support surface extending parallel to the output axis and generally transversely to the common plane, the support surface located relative the handle spaced upwardly from where the rearward extension of the output axis intersects the rear surface of the handle, and the support surface intersecting with the rear surface and the side surfaces of the handle and extending rearwardly and sideways from each of the rear surface and the side surfaces of the handle, the support surface being symmetrical about the common plane.

* * * * *